US008157421B2

(12) United States Patent
Lee

(10) Patent No.: US 8,157,421 B2
(45) Date of Patent: Apr. 17, 2012

(54) LIGHT EMITTING DIODE LAMP

(75) Inventor: Ke-Chin Lee, Taipei (TW)

(73) Assignee: Yeh-Chiang Technology Corp., Taipei (TW)

( * ) Notice: Subject to any disclaimer, the term of this patent is extended or adjusted under 35 U.S.C. 154(b) by 158 days.

(21) Appl. No.: 12/683,485

(22) Filed: Jan. 7, 2010

(65) Prior Publication Data

US 2010/0314984 A1 Dec. 16, 2010

Related U.S. Application Data

(60) Provisional application No. 61/186,026, filed on Jun. 11, 2009.

(30) Foreign Application Priority Data

Jun. 12, 2009 (TW) ..... 98119658 A

(51) Int. Cl.
*F21V 29/00* (2006.01)

(52) U.S. Cl. ..... 362/294; 362/249.03; 362/650

(58) Field of Classification Search ..... 362/249.03, 362/249.1, 249.11, 269, 285, 287, 294, 218, 362/373, 649, 650, 651
See application file for complete search history.

(56) References Cited

U.S. PATENT DOCUMENTS

| | | | | |
|---|---|---|---|---|
| 7,610,947 | B2 * | 11/2009 | Wang et al. | 362/294 |
| 7,654,699 | B2 * | 2/2010 | Chang et al. | 362/294 |
| 7,914,184 | B2 * | 3/2011 | Liu | 362/373 |
| 8,029,158 | B2 | 10/2011 | Chen | |
| 2009/0097241 | A1 * | 4/2009 | Xu et al. | 362/294 |
| 2009/0196038 | A1 * | 8/2009 | Vargas Maciel | 362/249.03 |
| 2011/0317423 | A1 | 12/2011 | Chen | |

FOREIGN PATENT DOCUMENTS

| | | |
|---|---|---|
| JP | 2005-276467 | 10/2005 |
| JP | 2008-535227 | 8/2008 |
| WO | WO2008011723 A2 | 1/2008 |

* cited by examiner

*Primary Examiner* — Y My Quach Lee
(74) *Attorney, Agent, or Firm* — Rabin & Berdo, PC

(57) ABSTRACT

A light emitting diode (LED) lamp including a connector, an LED module, an angle adjusting ring, an isolating ring, and a heat dissipating module is provided. The LED module is electrically connected to the connector and has at least one LED unit. The angle adjusting ring is disposed between the LED module and the connector for rotating the LED module, and includes at least one locking element for fixing the LED module on the connector. The isolating ring is disposed between the connector and the angle adjusting ring. The heat dissipating module is in contact with the LED module for preventing the LED module from overheating. The heat dissipating module includes at least one heat pipe and a plurality of fins connecting to the at least one heat pipe, where the at least one LED unit is disposed on the at least one heat pipe.

15 Claims, 6 Drawing Sheets

LIGHT EMITTING DIODE LAMP

This application claims the benefits of U.S. application Ser. No. 61/186,026, filed Jun. 11, 2009 and Taiwan application Serial No. 98119658, filed Jun. 12, 2009, the subject matter of which is incorporated herein by reference.

BACKGROUND OF THE INVENTION

1. Field of the Invention

The invention relates in general to a lamp, and more particularly to a light emitting diode lamp.

2. Description of the Related Art

Conventional lamps such as mercury ultraviolet lamps, fluorescent lamps, incandescent lamps, halogen lamps, etc. all have their particular uses nowadays. The lighting of those lamps does provide us with great convenience and help in our daily life. However, not all of the conventional lamps are environmentally friendly and have long lifespan.

Take the mercury ultraviolet lamps for example. At present, they are mostly used in the street lighting. But, when they are functioning, toxic gas is generated and released to the ambient environment, seriously polluting the atmosphere. Besides, the mercury ultraviolet lamps have a short lifespan of 3000 hours, and consume a large amount of energy when driven, dissatisfying the requirement for green technology.

SUMMARY OF THE INVENTION

The invention is directed to a light emitting diode (LED) lamp. The LED lamp has a heat dissipating mechanism for avoiding the LED lamp from overheating. Besides, the LED lamp can be used in conventional lamp holders without any difficulty. Moreover, the LED lamp has higher lifespan than the conventional lamps and is more environmentally friendly.

According to the present invention, an LED lamp that includes a connector, an LED module, an angle adjusting ring, an isolating ring, and a heat dissipating module is provided. The LED module is electrically connected to the connector and has at least one LED unit. The angle adjusting ring is disposed between the LED module and the connector for rotating the LED module so as to change a light emitting direction of the at least one LED unit, wherein the angle adjusting ring includes at least one locking element for fixing the LED module on the connector after rotated to a required direction. The isolating ring is disposed between the connector and the angle adjusting ring. The heat dissipating module is in contact with the LED module for preventing the LED module from overheating. The heat dissipating module includes at least one heat pipe and a plurality of fins connecting to the at least one heat pipe, where the at least one LED unit is disposed on the at least one heat pipe.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
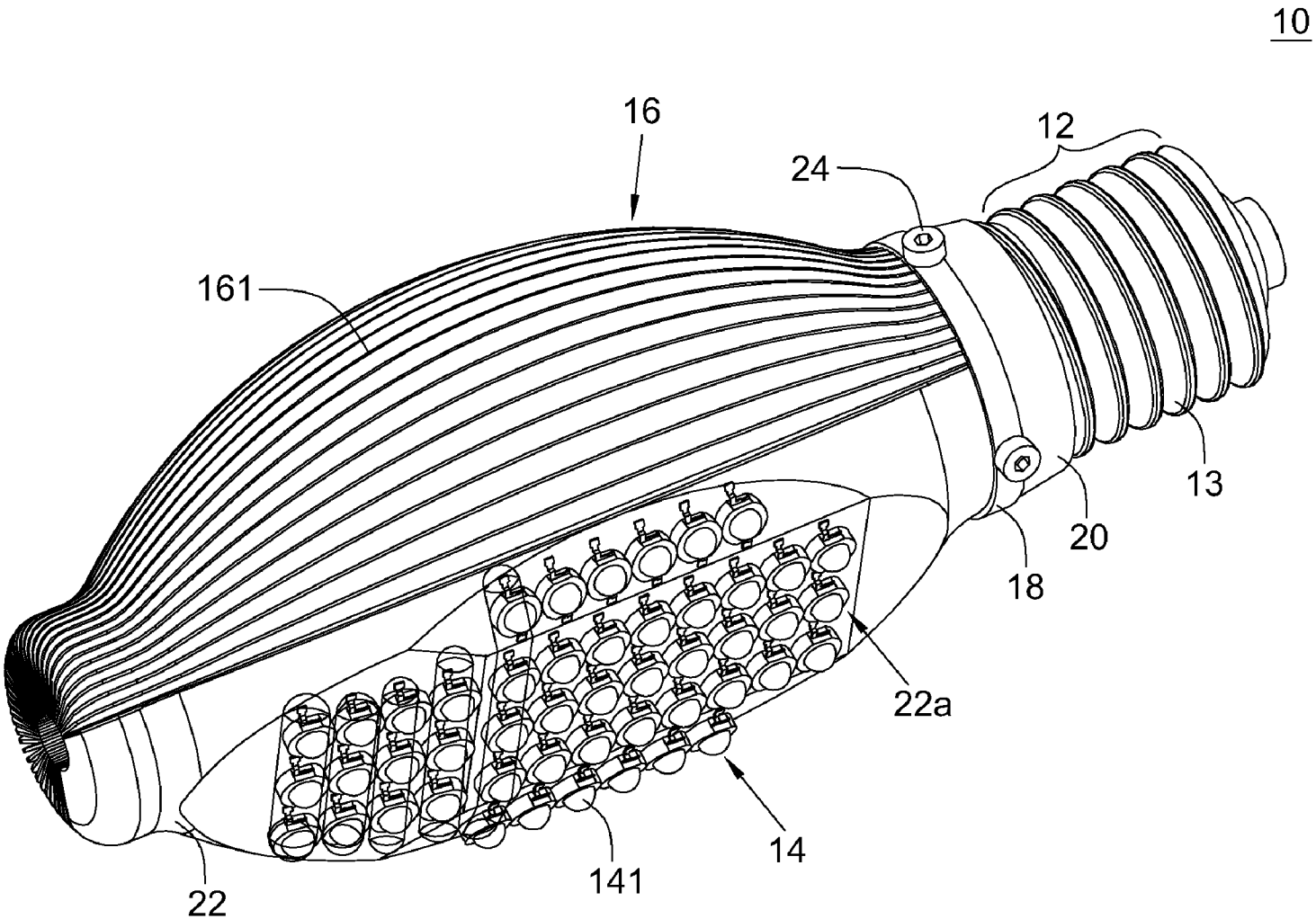
FIG. 1 is a diagram showing a light emitting diode (LED) lamp according to an embodiment of the invention.
Figure 2:
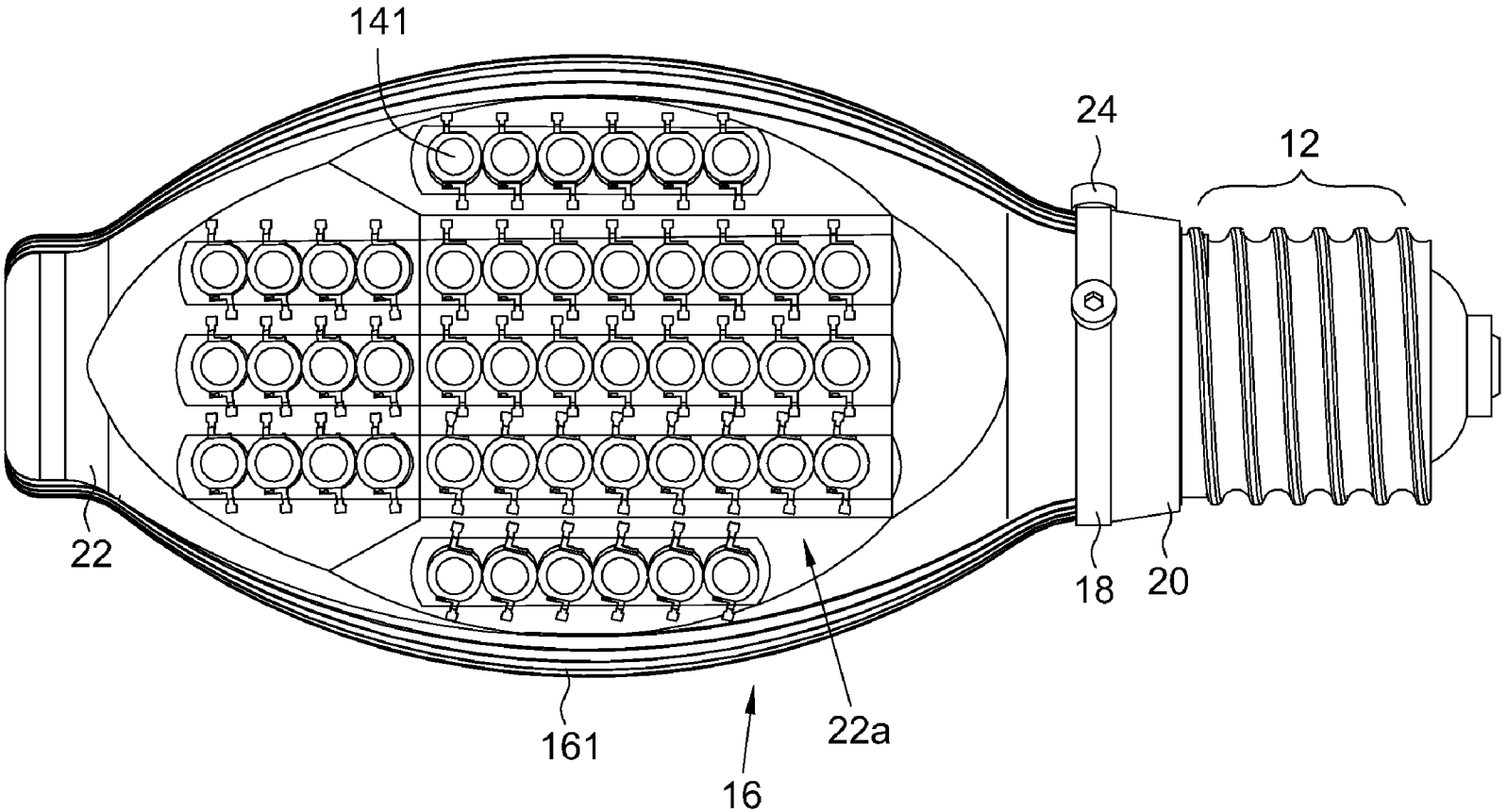
FIG. 2 is a diagram showing the front side of the LED lamp of FIG. 1.
Figure 3:
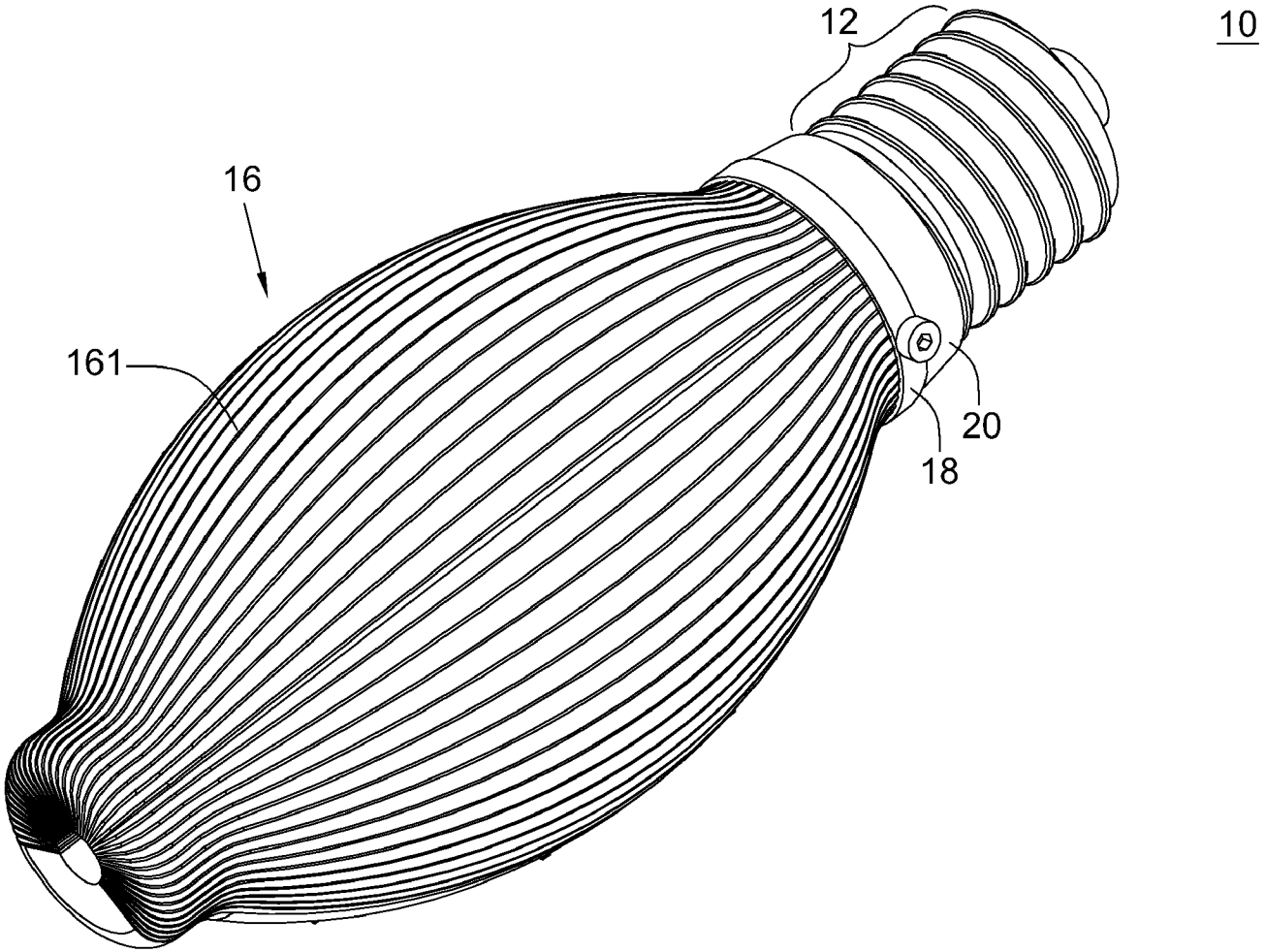
FIG. 3 is a diagram showing the rear side of the LED lamp of FIG. 1.

Referring to FIGS. 1 to 3, FIG. 1 is a diagram showing a light emitting diode (LED) lamp according to an embodiment of the invention, FIG. 2 is a diagram showing the front side of the LED lamp of FIG. 1, FIG. 3 is a diagram showing the rear side of the LED lamp of FIG. 1. The LED lamp 10 includes a connector 12, an LED module 14 and a heat dissipating module 16. The connector 12 is, for example, a metal connector, and includes a threaded joint 13. The threaded joint 13 can be E40 joint, E27 joint, or any other conventional joint. The LED module 14 is electrically connected to the connector 12 and has at least one LED unit. In the embodiment, a plurality of LED units 141 are used in the LED lamp 10 for example. As shown in FIG. 2, the LED units 141 are arranged according to a predetermined pattern however the invention is not limited thereto. The LED units 141 can also be disposed in a random form. The LED units 141 each can be an LED package that has at least one LED diode for emitting light.

The heat dissipating module 16 is in contact with the LED module 14 for preventing the LED module 14 from overheating. The heat dissipating module 16 includes a plurality of fins 161, which preferably are disposed evenly on the LED lamp 10, as shown in FIG. 3. In other words, the fins 161 are spaced apart from each other with the same interval. Besides, the fins 161 each have identical size and shape for enhancing the artistic appearance of the LED lamp 10. And, the interval between any two adjacent edges of the fins 161 close to an axis of the connector 12 is smaller than the interval between any two adjacent edges of the fins 161 distant from the axis of the connector 12. For example, each of the fins 161 has one arc-shaped edge, so that the LED lamp 10 is able to present a streamline contour. Because of the heat dissipating module 16, the number of the LED units 141 of the LED module 14 can be increased without arising any overheating problem, which improves the light emitting efficiency of the LED module 14.

The LED lamp 10 further includes an angle adjusting ring 18, an isolating ring 20 and a lamp cover 22. The angle adjusting ring 18 is disposed between the LED module 14 and the connector 12 for rotating the LED module 14, so as to change a light emitting direction of the LED units 141. Preferably, the angle adjusting ring 18 movably surrounds the connector 12, and the LED module 14 is fixed on the angle adjusting ring 18, so that the LED module 14 is able to rotate along with the angle adjusting ring 18. The angle adjusting ring 18 includes at least one locking element 24 for fixing the LED module 14 on the connector 12 after the LED module 14 is rotated to a required direction. The locking element 24 includes, for example, a screw that penetrates the ring body of the angle adjusting ring 18 and close to the connector 12. As the locking element 24 is loosed and its screw does not press against the connector 12, the angle adjusting ring 18 can rotate relative to the connector 12. As the locking element 24 is fastened, the angle adjusting ring 18 is immovable on the connector 12.

The isolating ring 20 is disposed between the angle adjusting ring 18 and the connector 12 for avoiding the electrical connection of the angle adjusting ring 18 and the connector 12 as well as any inadvertent touch from the user. The lamp cover 22 is disposed in accordance with the LED module 14 for protecting the LED module 14. For sending out the light emitted from the LED units 141, at least one portion of the lamp cover 22 corresponding to the LED units 141 should be transparent and has excellent light transmittance. Or, the lamp cover 22 has at least one opening for exposing the LED units 141. In the embodiment, the lamp cover 22 has an opening 22*a* corresponding to the LED units 141. Preferably, the opening 22*a* can be filled up with a transparent board (not shown) so as to provide both light transmission and protection functions for the LED units 141.

Figure 4:
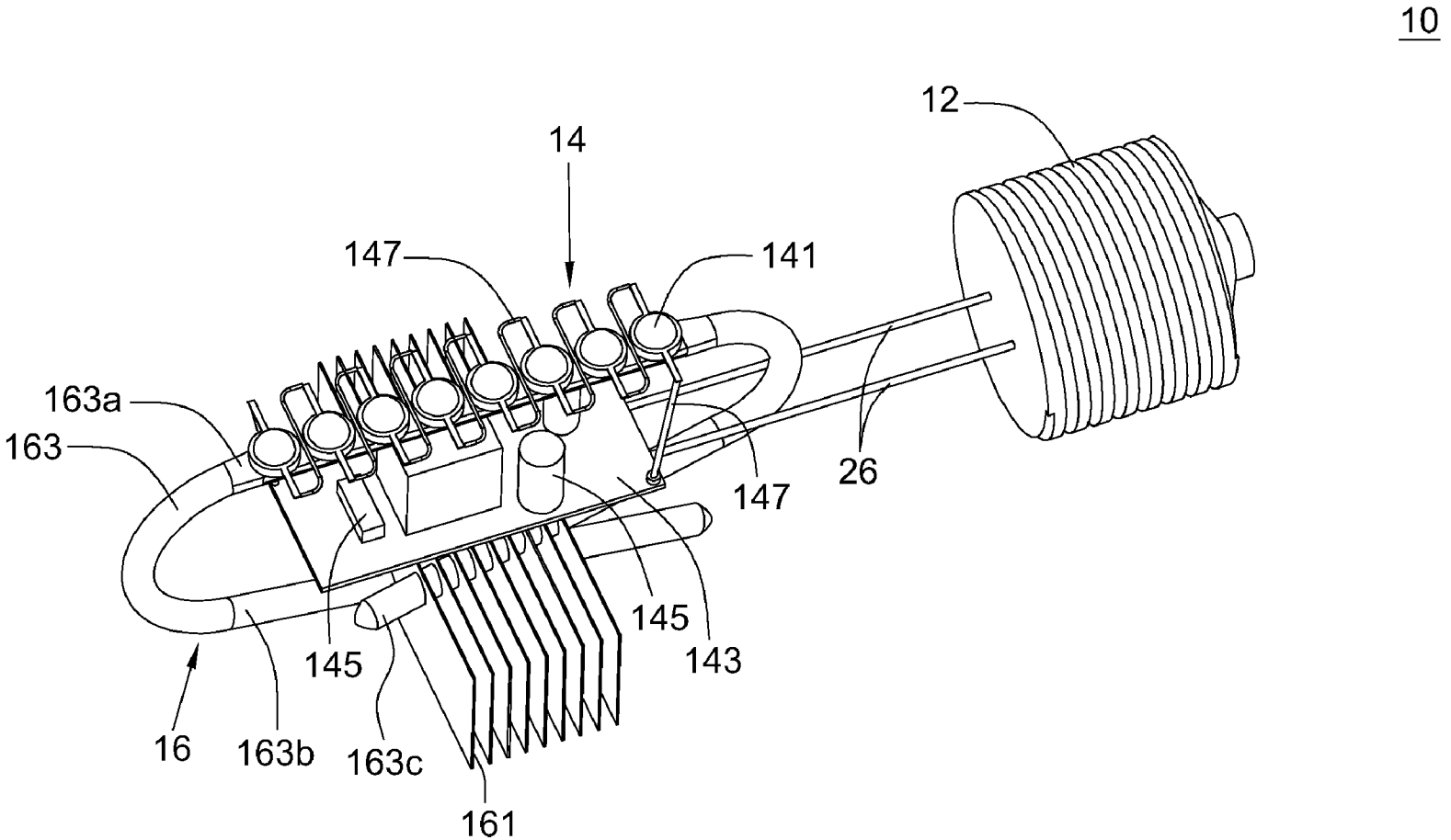
FIG. 4 is a diagram showing the inside structure of the LED lamp of FIG. 1.

Refer to FIG. 4, which is a diagram showing the inside structure of the LED lamp of FIG. 1. The LED lamp 10 further includes two flexible wires 26 electrically connecting to the LED module 14 and the connector 12. The LED module 14 further includes a circuit board 143, a plurality of electronic elements 145 and a plurality of conductive wires 147. The electronic elements 145 are fixed and electrically connected to the circuit board 143. The LED units 141 are electrically connected to each other and to the circuit board 143 by the conductive wires 147. The flexible wires 26 connect to the circuit board 143.

The heat dissipating module 16 further includes at least one heat pipe 163 for loading the LED units 141 and connecting to the fins 161, so as to conduct the heat of the LED units 141 to the fins 161 by the functioning of the heat pipe 163 and dissipate the heat to the exterior by the fins 161. The heat pipe 163 is, for example, a sintered type heat pipe that has a capillary structure formed by sintered powders. In the embodiment, the heat pipe 163 penetrates the fins 161, and the extension direction of the heat pipe 163 is perpendicular to the surface of each fin 161. As shown in FIG. 4, the heat pipe 163 includes a first pipe segment 163*a*, a second pipe segment 163*b* and a third pipe segment 163*c*, wherein the second pipe segment 163*b* and the third pipe segment 163*c* are interlaced and disposed opposite to the first pipe segment 163*a*. The LED units 141 are disposed on the first pipe segment 163*a*, and the fins 161 are penetrated by the second pipe segment 163*b* and the third pipe segment 163*c*. The first pipe segment 163*a* preferably has a flat surface for facilitating the installation of the LED units 141 and increasing the contact area between the LED units 141 and the heat pipe 163. Thus, the manufacture of the LED lamp 10 is less complicated, the combination between the LED units 141 and the heat pipe 163 is strengthened, and the heat dissipating efficiency is improved.

Figure 5:
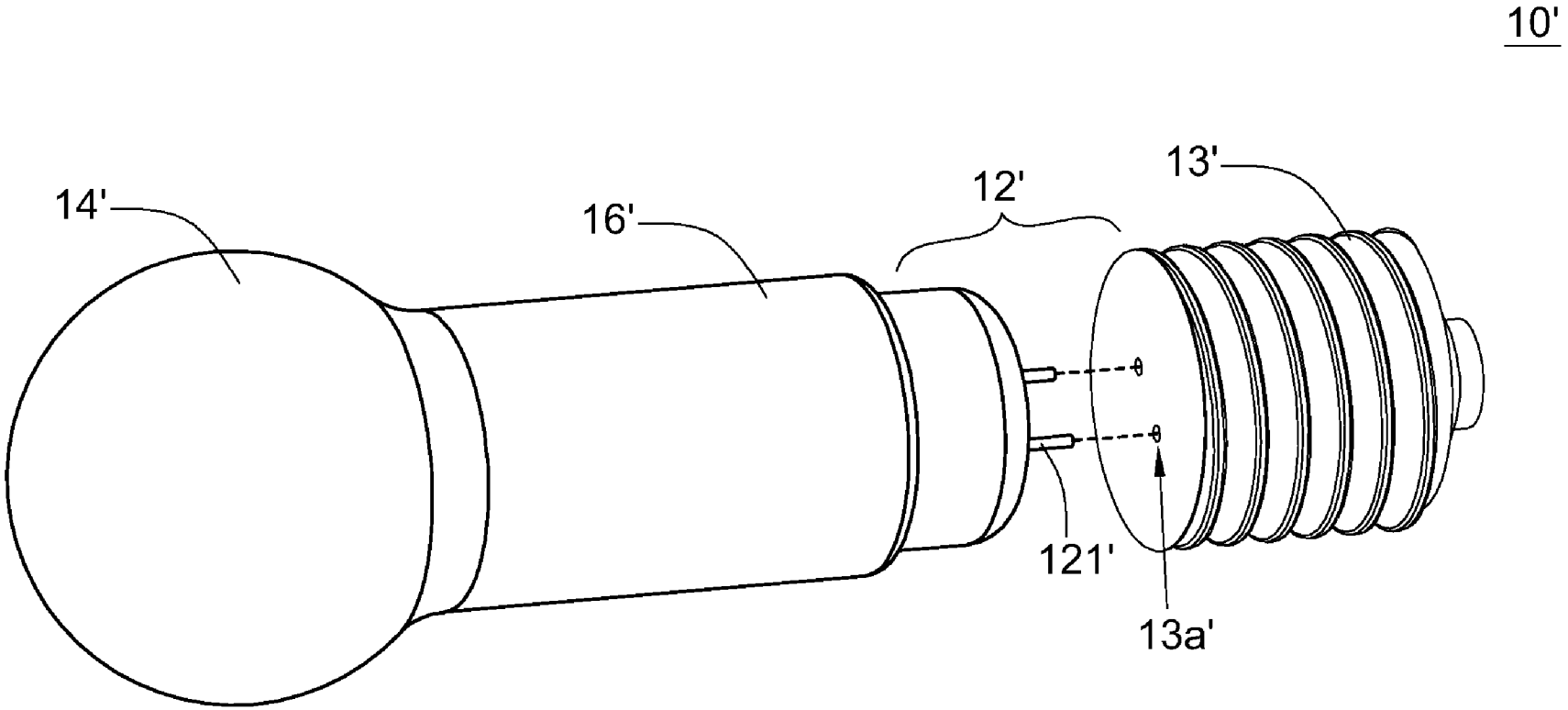
FIG. 5 is a diagram showing an LED lamp according to another embodiment of the invention.

Refer to FIG. 5, which is a diagram showing an LED lamp according to another embodiment of the invention. The LED lamp 10' differs from the LED lamp 10 of FIG. 1 in the contour of the LED lamp 10' and the type of the connector 12'. The LED module 14' is located on the front end of the LED lamp 10', the heat dissipating module 16' is located on the middle section of the LED lamp 10'. The LED module 14' is, for example, in the shape of a ball. Thus, as the LED module 14' emits light, the light is not guided toward an identical direction, which is quite different from that of the LED lamp 10' (shown in FIG. 1). Moreover, the heat from the LED module 14' is conducted to the heat dissipating module 16', and dissipated to the exterior by the heat exchange of the heat dissipating module 16' and the ambient fluid such as air.

The connector 12' is, for example, an MR16 connector, and includes two plug feet 121' for electrically inserting to sockets to receive power. However, this type of connector 12' cannot be directly assembled with conventional threaded sockets. As shown in FIG. 5, the LED lamp 10' further includes an intermediate threaded joint 13' that has two holes 13*a*' for receiving the plug feet 121'. Therefore, when only a threaded socket is provided, the connector 12' first can be combined with the intermediate threaded joint 13' by inserting the plug feet 121' to the holes 13*a*'. Then, the LED lamp 10' can be electrically connected to the threaded socket by rotating the intermediate threaded joint 13' into the threaded socket.

Figure 6:
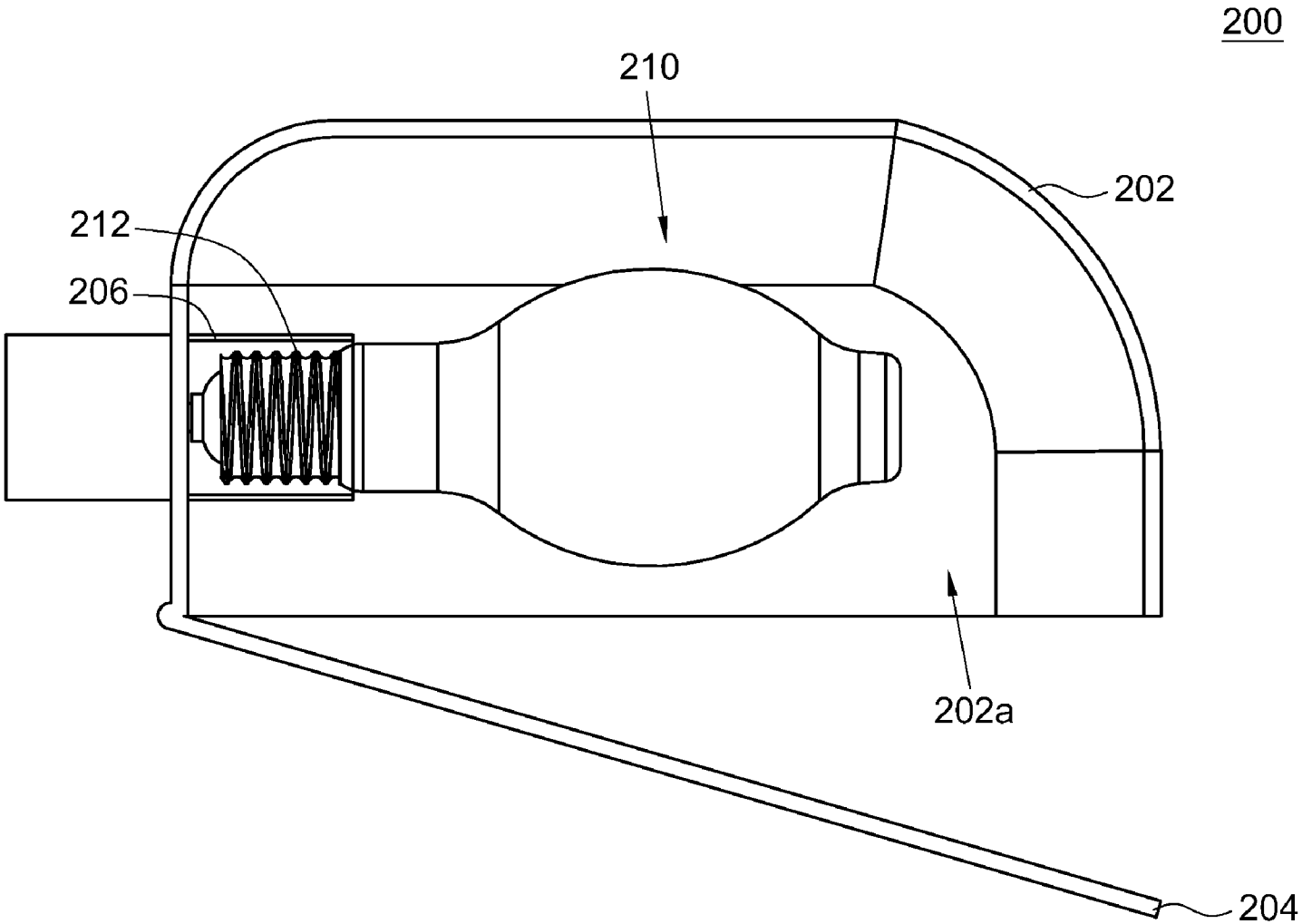
FIG. 6 is a diagram showing a conventional lamp holder.

Refer to FIG. 6, which is a diagram showing a conventional lamp holder. The conventional lamp holder 200 includes a rear cover 202 and a front cover 204, and a threaded socket 206 is disposed on the rear cover 202. The front cover 204 is movably disposed on the rear cover 202 and corresponds to an opening 202*a* of the rear cover 202. As the front cover 204 is open, a lamp 210 can be assembled to or disassembled from the lamp holder 200. As the lamp 210 is disposed within the lamp holder 200, its connector 212 is received within the threaded socket 206. The lamp 210 is a conventional lamp such as a mercury ultraviolet lamp. However, the LED lamps 10 and 10' of FIGS. 1 and 5 can also be used in the conventional lamp holder 200 since the LED lamps 10 and 10' both have threaded joints 13, 13'. Moreover, replacing the conventional lamps, especially the mercury ultraviolet lamps, by the LED lamps disclosed in the embodiments is more environmentally beneficial and friendly because the LED lamp does not generate and release any toxic gas to the ambient environment when driven to emit light.

Take the LED lamp 10 of FIG. 1 for example. After the LED lamp 10 is assembled to the lamp holder 200, the light emitting direction of the LED lamp 10 should be adjusted because the LED units 141 do not necessarily align with the opening 202*a* of the rear cover 202 (shown in FIG. 6). By rotating the angle adjusting ring 18 and the LED module 14, the direction of the LED units 141 is thus changed. After adjustment, the LED units 141 face the opening 202*a* and the light emitting direction of the LED lamp 10 is correct, then the locking element 24 can fasten the LED module 14 on the LED lamp 10. Although the receiving space of the rear cover 202 is limited and may hinder the heat dissipating effect of the LED lamp 10, the natural convention remains existent within the rear cover 202 and helps the dissipation of heat. Besides, the LED lamp 10 is equipped with heat pipes and fins and its size can be well controlled, the overheating problem is greatly alleviated, which indeed prolongs the lifespan of the LED lamp 10.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode (LED) lamp, comprising:

a connector;

an LED module electrically connected to the connector, wherein the LED module comprises at least one LED unit;

an angle adjusting ring disposed between the LED module and the connector for rotating the LED module so as to change a light emitting direction of the at least one LED unit, wherein the angle adjusting ring comprises at least one locking element for fixing the LED module on the connector after rotated to a required direction;

an isolating ring disposed between the connector and the angle adjusting ring; and a heat dissipating module, being in contact with the LED module, wherein the heat dissipating module comprises:

at least one heat pipe having a sintered capillary structure, comprising:

a first pipe segment having an outer wall on which the at least one LED unit is directly disposed;

a second pipe segment opposite to the first pipe segment; and a third pipe segment opposite to the first pipe segment; and a plurality of fins connecting to the at least one heat pipe, wherein the fins are penetrated by the second pipe segment and the third pipe segment which are interlaced.

2. The LED lamp according to claim 1, wherein the angle adjusting ring movably surrounds the connector, the LED module is fixed on the angle adjusting ring.

3. The LED lamp according to claim 1, further comprising:

two flexible wires electrically connecting to the LED module and the connector.

4. The LED lamp according to claim 1, wherein the extension direction of the at least one heat pipe is perpendicular to the surface of each fin.

5. The LED lamp according to claim 1, wherein the fins are spaced apart from each other with the same interval.

6. The LED lamp according to claim 1, wherein the fins each have at least one arc-shaped edge.

7. The LED lamp according to claim 1, wherein the outer wall on which the at least one LED unit is directly disposed has a flat surface for loading the at least one LED unit.

8. The LED lamp according to claim 1, wherein the interval between any two adjacent edges of the fins close to an axis of the connector is smaller than the interval between any two adjacent edges of the fins distant from the axis of the connector.

9. The LED lamp according to claim 1, wherein the LED module further comprises a circuit board electrically connected to the at least one LED unit.

10. The LED lamp according to claim 1, further comprising:

a lamp cover disposed in accordance with the LED module for protecting the LED module.

11. The LED lamp according to claim 10, wherein at least one portion of the lamp cover corresponding to the at least one LED unit is transparent.

12. The LED lamp according to claim 10, wherein the lamp cover has at least one opening for exposing the at least one LED unit.

13. The LED lamp according to claim 1, further comprising:

a socket used for connecting to a power supply, wherein the connector is disposed on the socket.

14. The LED lamp according to claim 1, wherein the connector comprises a threaded joint.

15. The LED lamp according to claim 1, wherein the connector comprises two plug feet.

* * * * *